US011204223B2

(12) United States Patent
Ho

(10) Patent No.: US 11,204,223 B2
(45) Date of Patent: Dec. 21, 2021

(54) ASSEMBLY-TYPE PHYSICAL DART TARGET

(71) Applicant: Ming-Cheng Ho, Kaohsiung (TW)

(72) Inventor: Ming-Cheng Ho, Kaohsiung (TW)

( * ) Notice: Subject to any disclaimer, the term of this patent is extended or adjusted under 35 U.S.C. 154(b) by 19 days.

(21) Appl. No.: 16/718,288

(22) Filed: Dec. 18, 2019

(65) Prior Publication Data

US 2021/0190462 A1 Jun. 24, 2021

(51) Int. Cl.

| | |
|---|---|
| ***F41J 3/00*** | (2006.01) |
| ***F41J 3/02*** | (2006.01) |
| ***F41J 5/02*** | (2006.01) |
| ***F41J 5/08*** | (2006.01) |
| ***F41J 1/10*** | (2006.01) |

(52) U.S. Cl.

CPC ..... *F41J 3/009* (2013.01); *F41J 1/10* (2013.01); *F41J 3/00* (2013.01); *F41J 3/0004* (2013.01); *F41J 3/0019* (2013.01); *F41J 3/02* (2013.01); *F41J 5/02* (2013.01); *F41J 5/08* (2013.01)

(58) Field of Classification Search

CPC ..... F41J 3/0004; F41J 3/0009; F41J 3/0019; F41J 3/0061; F41J 3/0066; F41J 3/009; F41J 13/00; E04B 2/7422; E04B 2/7433; E04B 2/7437; E04B 2/766–767; E04B 2002/7461

See application file for complete search history.

(56) References Cited

U.S. PATENT DOCUMENTS 2,101,952 A * 12/1937 Olsen ..... E04B 2/78 52/242
3,697,073 A * 10/1972 Dooley ..... A63F 9/0208 273/358

(Continued)

FOREIGN PATENT DOCUMENTS

CN 203758377 U * 8/2014
KR 1020170065445 * 4/2019 ..... F41J 3/00

(Continued)

OTHER PUBLICATIONS

Danage Domino Powerstop #1, YouTube video posted by Rene Molgaard, www.youtube.com/watch?v=N9S4i-jJ9QY, Oct. 19, 2012 (Year: 2012).*

(Continued)

*Primary Examiner* — Laura Davison
(74) *Attorney, Agent, or Firm* — Bacon & Thomas, PLLC

(57) ABSTRACT

An assembly-type physical dart target includes assembly plates, engagement strips, and a frame. Each assembly plate is formed by an arrow standing layer and a projection layer, and has surface gloss higher than that of the arrow standing layer. The arrow standing layer has two sliding slots disposed on two sides thereof, respectively, and each sliding slot has a retraction side disposed on a side edge thereof away from the projection layer. Each engagement strip has two protruding side edges and an assembly part disposed thereon, and each protruding side edge is engaged with the sliding slot. Therefore, the target can provide a good projection effect, and make image projection technology work well in physical throwing exercise, and has nice structural strength to form a large target, so that a user can quickly assemble the target or partially disassemble the target for replacing a damaged part.

7 Claims, 13 Drawing Sheets

(56) References Cited

U.S. PATENT DOCUMENTS

| | | | | | |
|---|---|---|---|---|---|
| 4,069,627 | A * | 1/1978 | Pegg | E04B 1/24 | 52/93.1 |
| 5,273,291 | A * | 12/1993 | Giannetti | F41J 3/0004 | 273/358 |
| 5,328,190 | A * | 7/1994 | Dart | A63F 9/0291 | 273/358 |
| 5,649,706 | A * | 7/1997 | Treat, Jr. | F41J 9/14 | 273/358 |
| 2007/0246887 | A1 * | 10/2007 | Kagami | F41J 3/0042 | 273/371 |
| 2020/0116459 | A1 * | 4/2020 | Schlangen | F41J 3/0004 | |

FOREIGN PATENT DOCUMENTS

| | | | | | |
|---|---|---|---|---|---|
| TW | M480669 | U * | 6/2014 | | |
| TW | M523846 | U * | 6/2016 | | |
| WO | WO-2004076959 | A1 * | 9/2004 | F41J 3/0004 | |

OTHER PUBLICATIONS

Domino Targets, danage-targets.com, archived Oct. 19, 2018 (Year: 2018).*
English machine translation of TW M480669 U (Year: 2014).*
English machine translation of CN 203758377 U (Year: 2014).*
English machine translation of TW M523846 U (Year: 2016).*
English machine translation of KR 10-2017-0065445 (Year: 2019).*

* cited by examiner

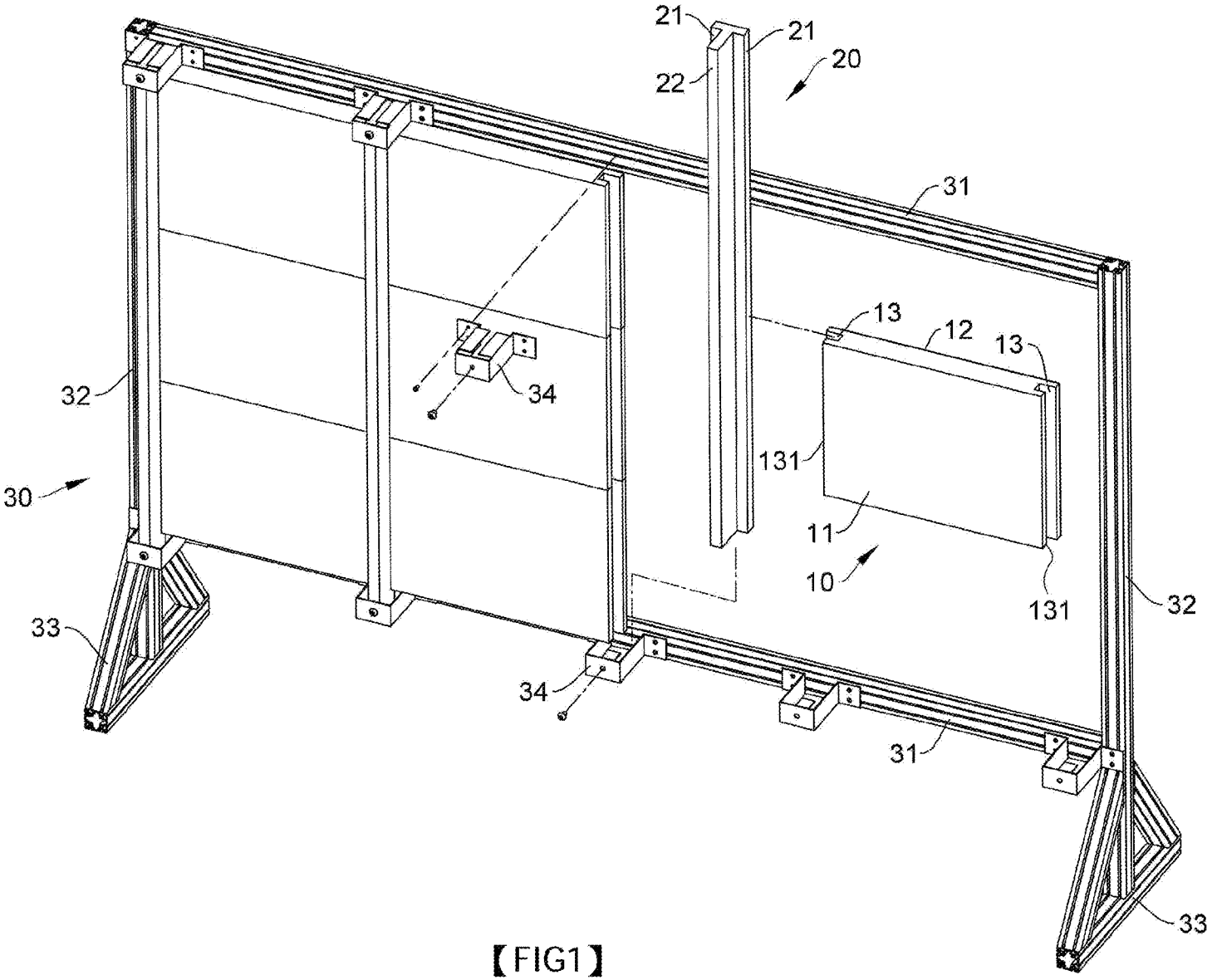
【FIG1】

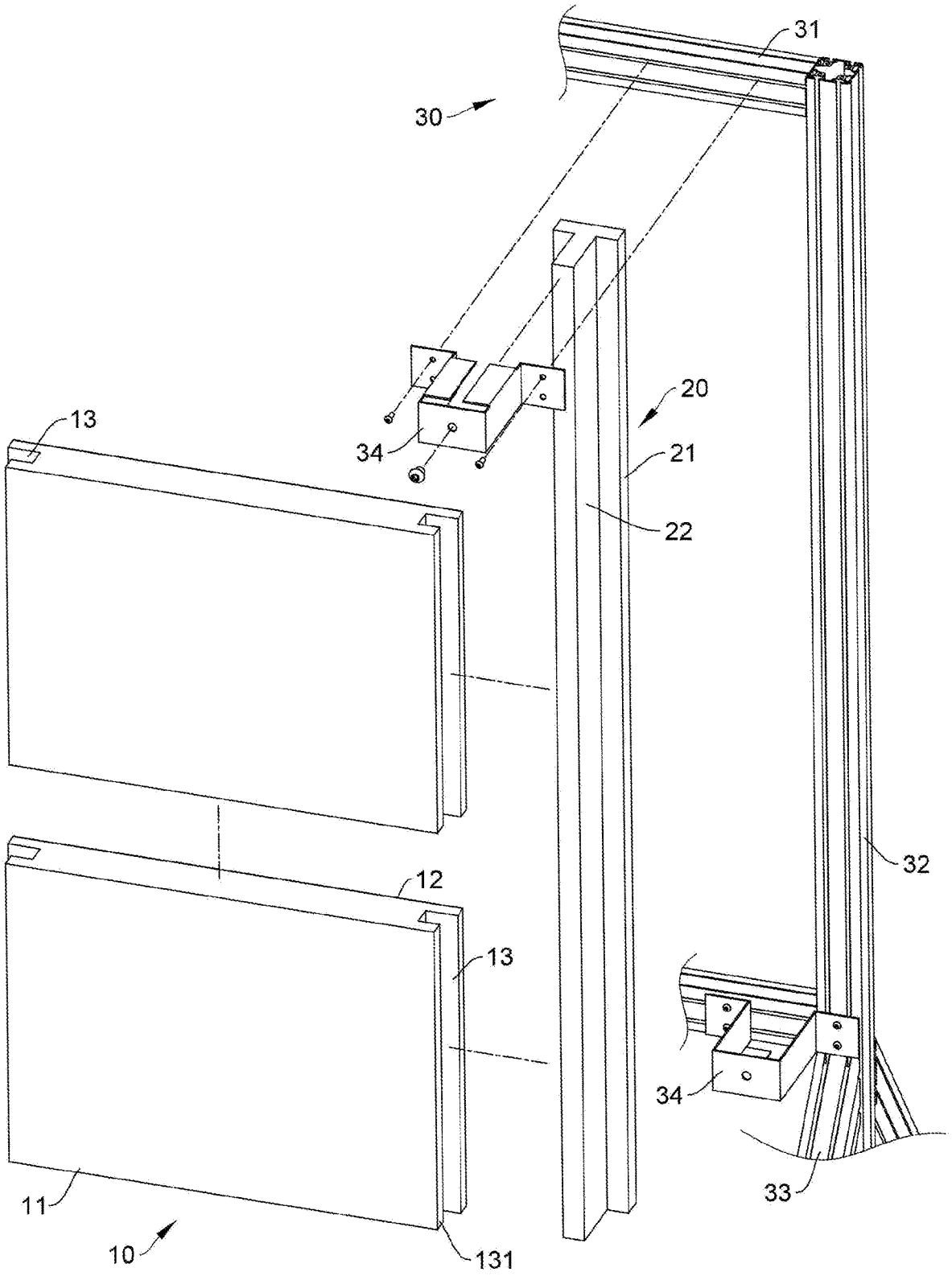
【FIG2】

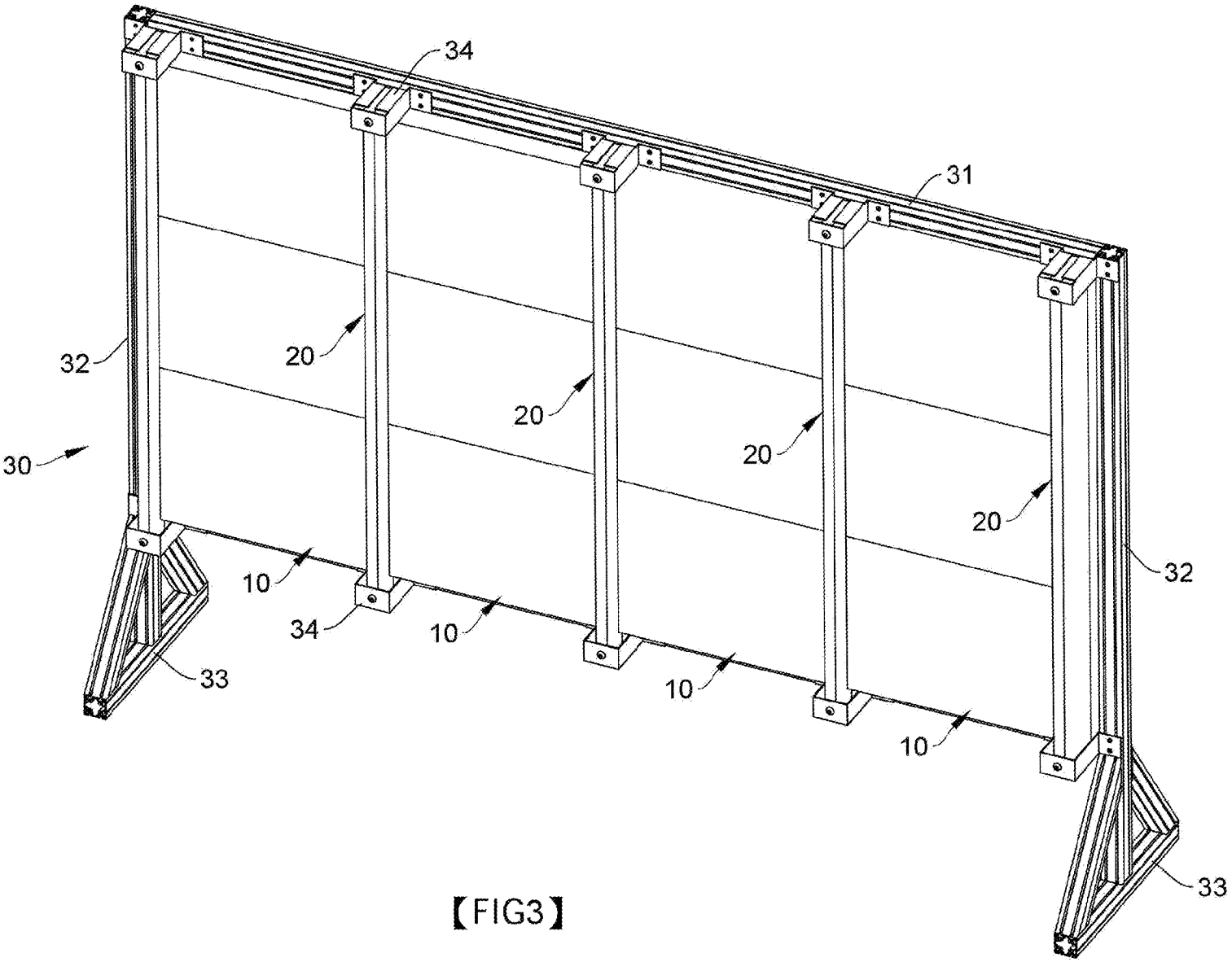
【FIG3】

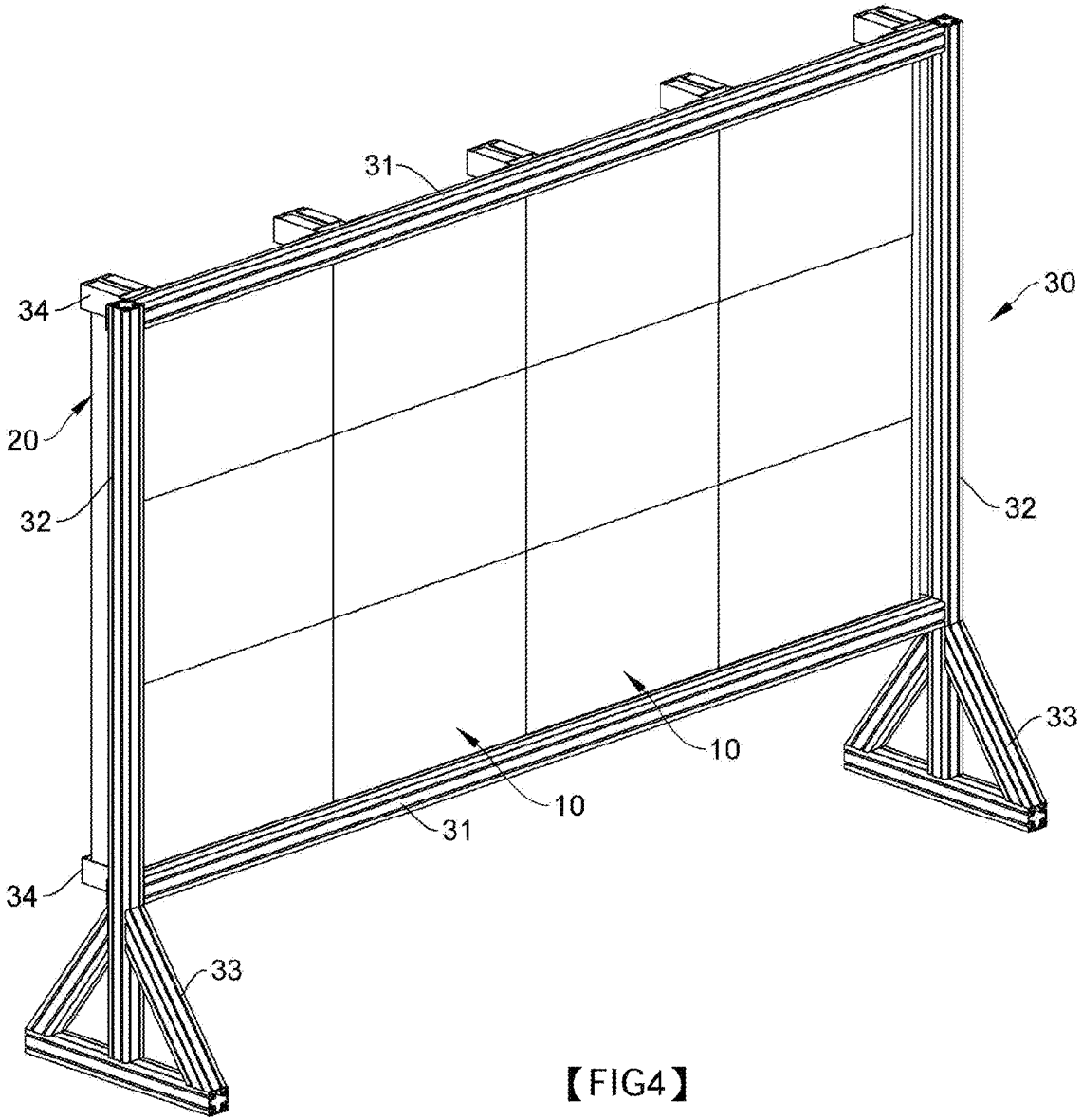
【FIG4】

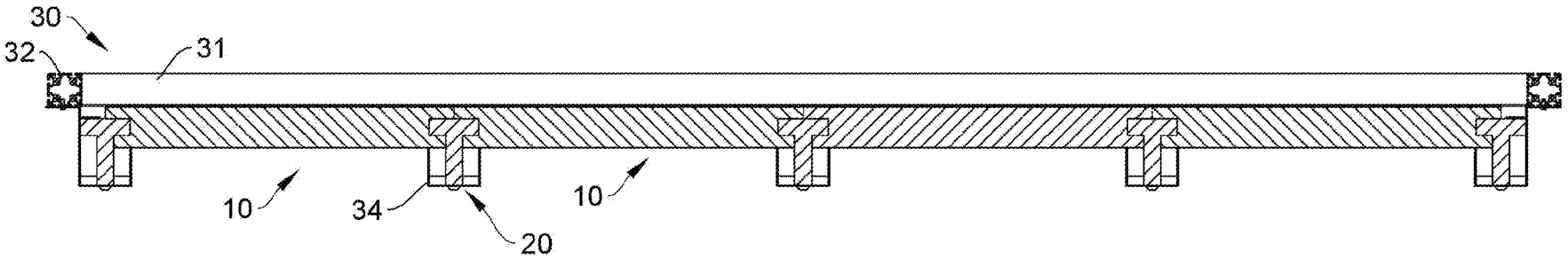
【FIG5】

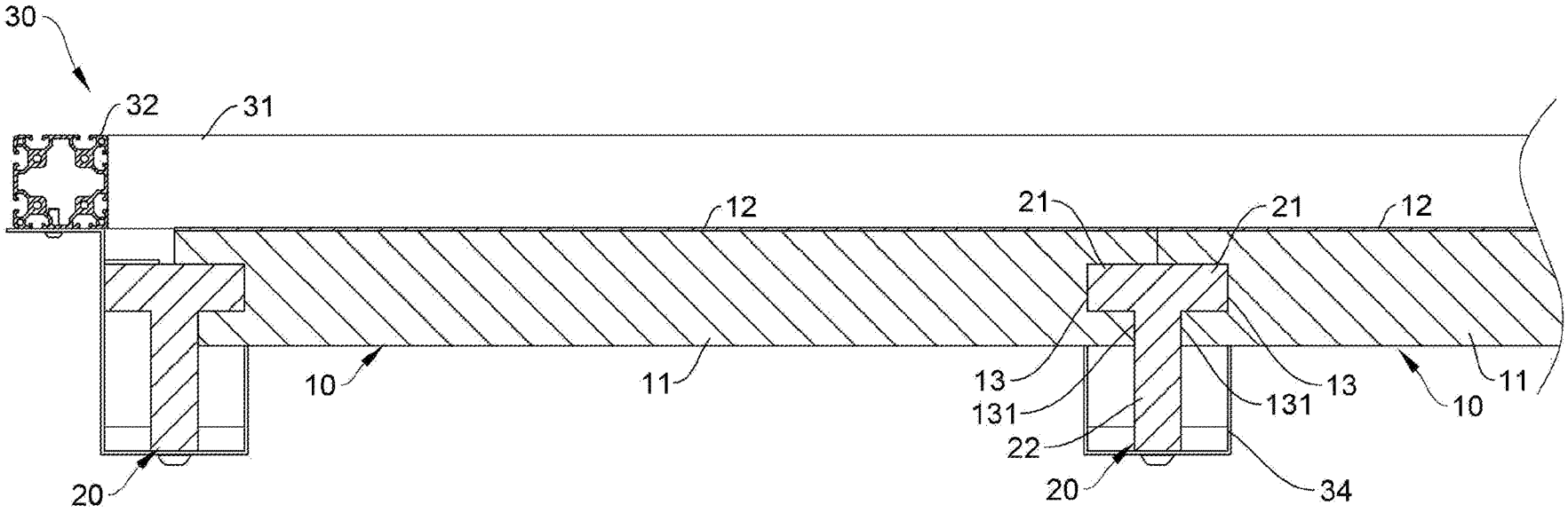
【FIG 6】

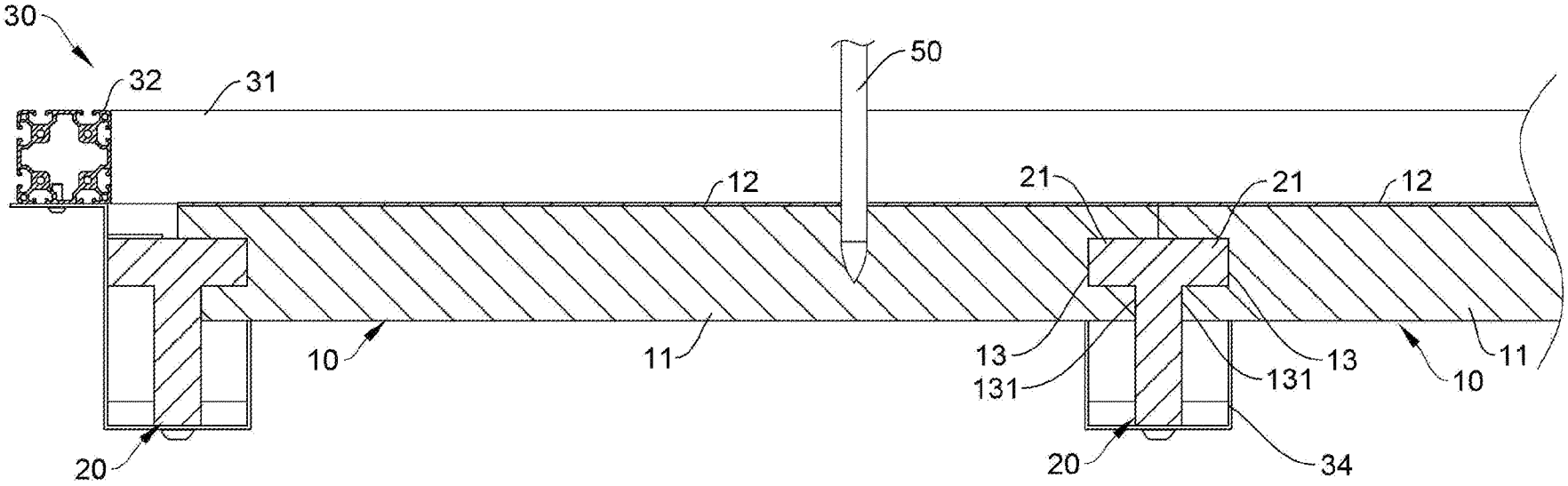
【FIG7】

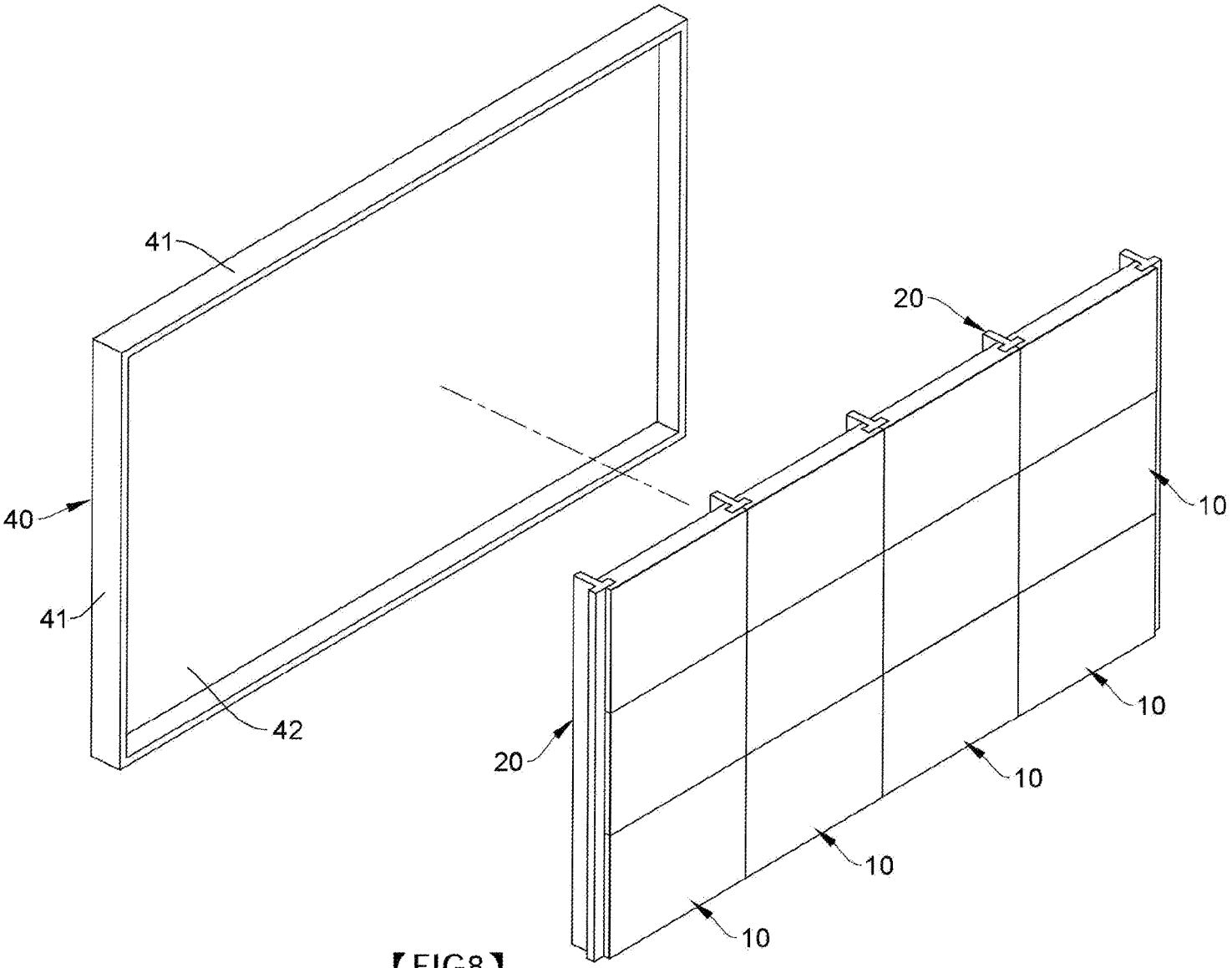
【FIG8】

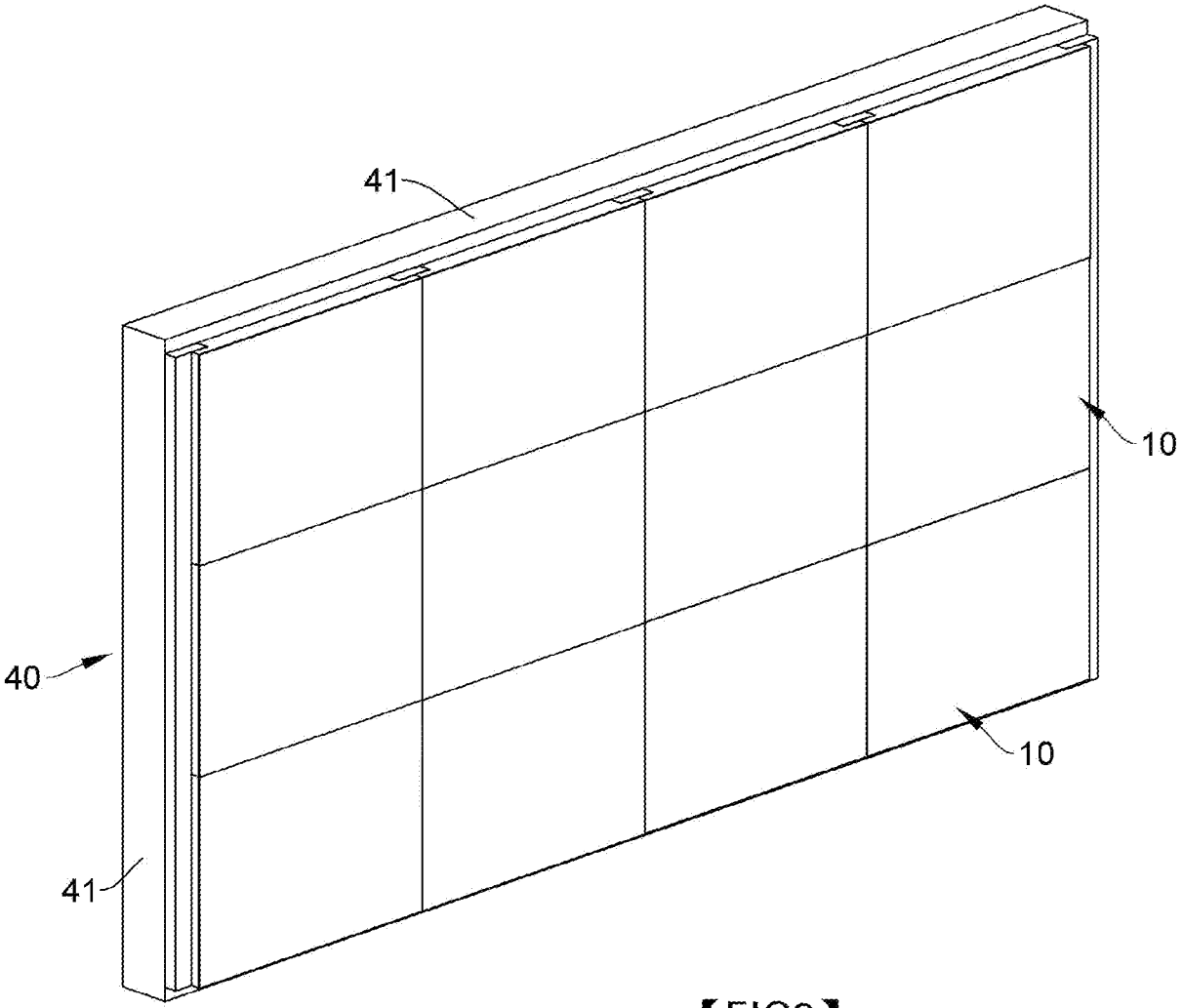
【FIG9】

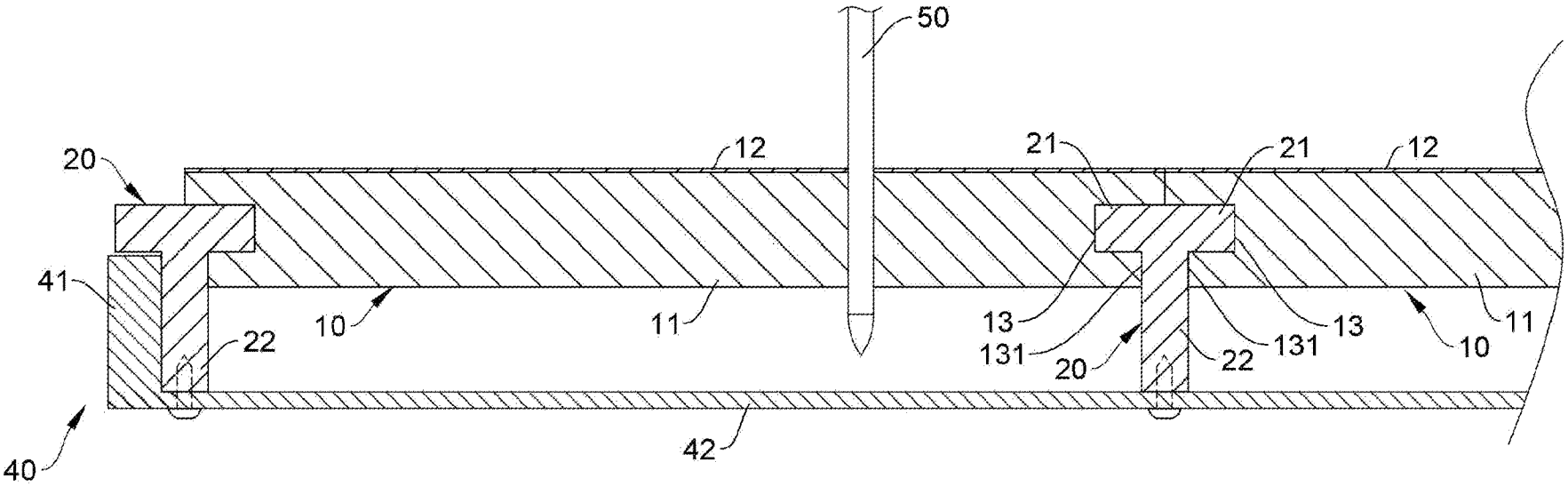
【FIG10】

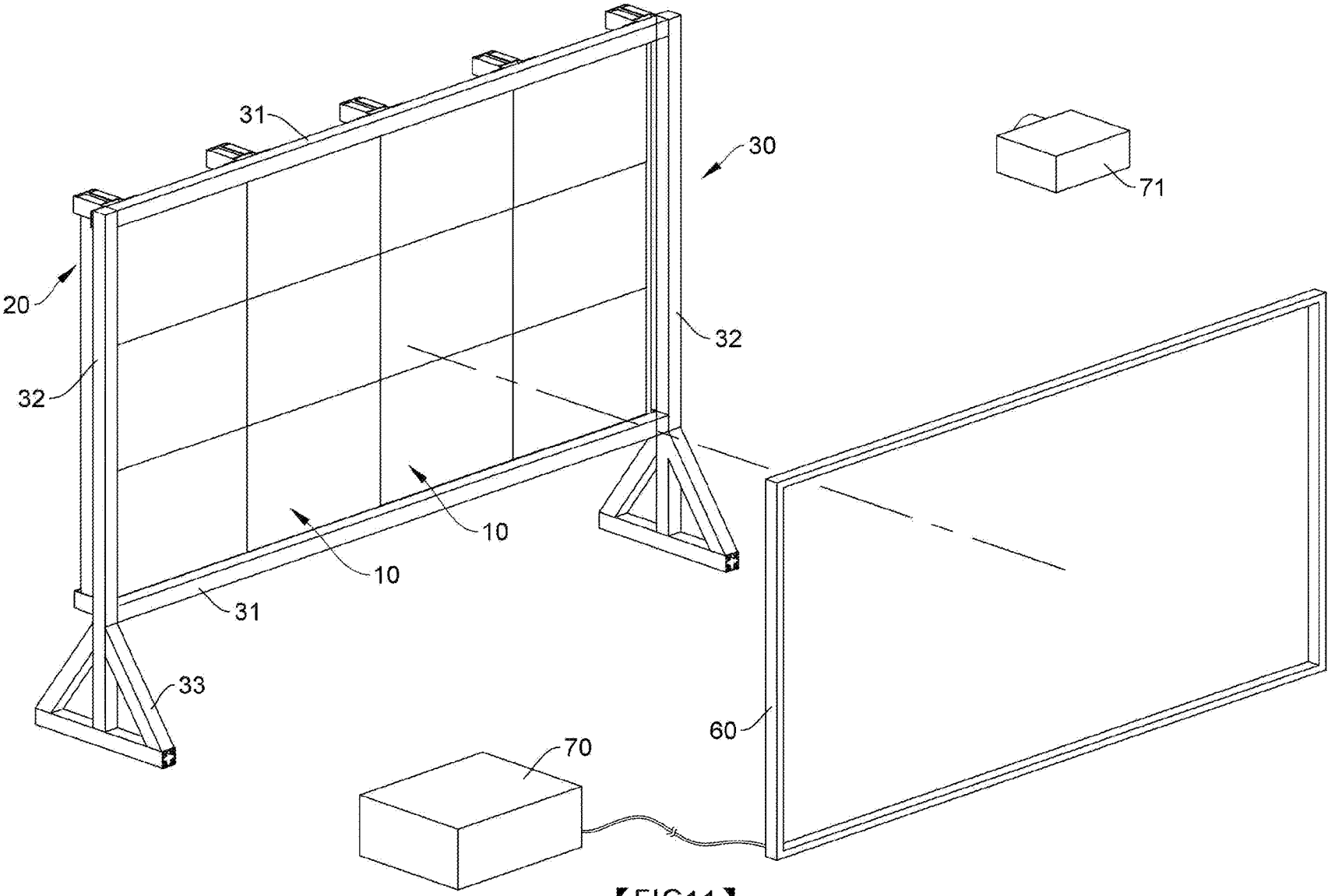
【FIG11】

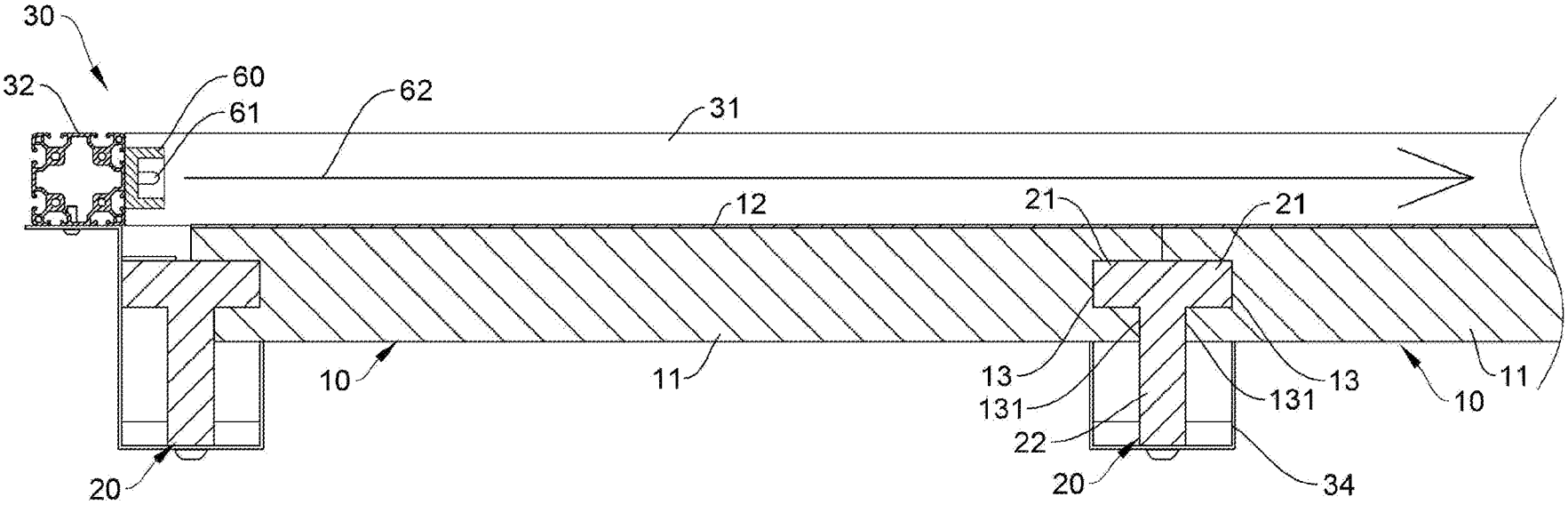
【FIG12】

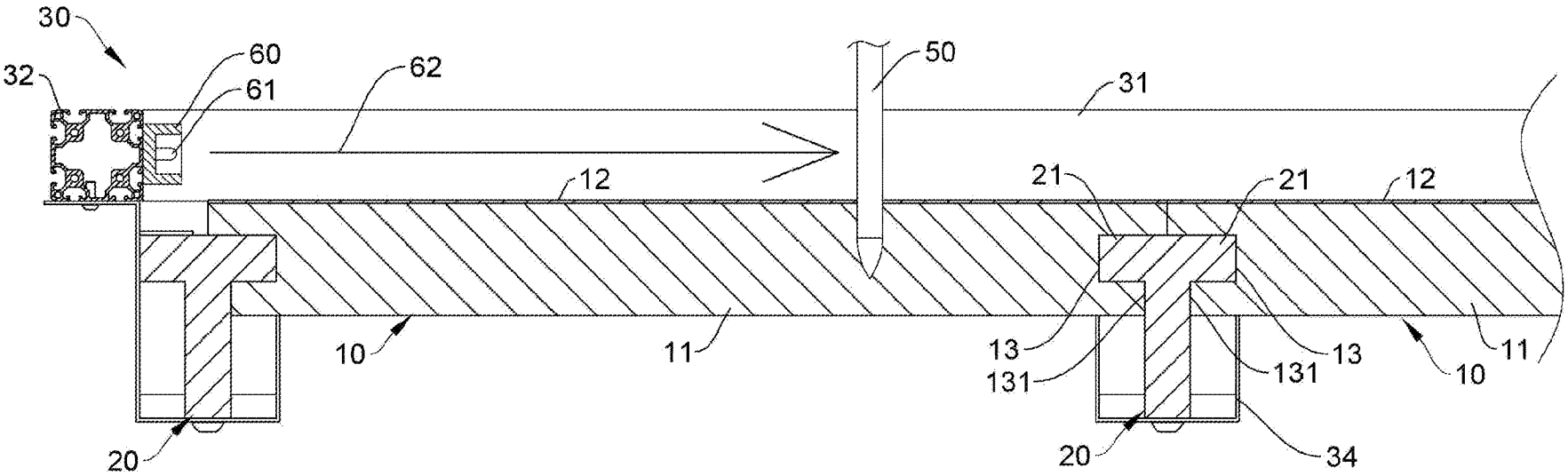
【FIG13】

ASSEMBLY-TYPE PHYSICAL DART TARGET

BACKGROUND OF THE INVENTION

1. Field of the Invention

The present invention relates to a target, more particularly to an assembly-type target for physical throwing exercise.

2. Description of the Related Art

Physical throwing exercise is a kind of exercise suitable for various age groups, for example, archery can train muscles and develop systemic coordination stability. The motions of throwing flying knives or darts can train muscles and further train the body to act with more accurate coordination. However, since the target for physical throwing exercise is a consumable which is consumed quickly, and it is time-consuming and costly to replace the target. Therefore, it is worth improving the convenience of replacing and assembling the target, and reducing the consumption of consumables.

In conventional art, ROC issued utility model patent No. M523846, discloses that multiple target units are mutually mounted, and each target unit include at least one concave portion or convex portion formed on an outer peripheral end surface thereof, and mounted correspondingly with a convex portion or a concave portion of another target unit, so as to form the target. The conventional target has a band hooped around the outer periphery of the target to stabilize the target units of the target. Furthermore, multiple reinforcing pads can be disposed cross corners of the target to shield the concave parts and the convex parts of the outermost target units of the target, so as to provide a strong flat plate to be tightly hooped by the band.

The above-mentioned conventional target can be assembled by the concave-convex mounting manner, but the target units of the target are hooped by the band only to prevent the target units from scattering, and no other support structure is disposed between the multiple target units, so the entire target is easily disintegrated after a large number of shooting operations, and the target having a larger area is more easily to disintegrate.

Furthermore, with rapid advancement of imaging technology, virtual reality technology or interactive projection technology is fully developed, and these technologies are beginning to be applied to the physical throwing exercise. However, the above-mentioned or other conventional technology does not disclose how to improve projection effect; for example, the surface of the conventional target is usually rough, and it reduces resolution and display effect of the projected image.

Therefore, it is necessary to provide a new target structure to improve the drawbacks of the conventional art.

SUMMARY OF THE INVENTION

An objective of the present invention is to provide an assembly-type physical dart target which can provide a good projection effect and make the image projection technology work well in physical throwing exercise.

Another objective of the present invention is to provide an assembly-type physical dart target in which a damaged part can be partially replaced.

Another objective of the present invention is to provide an assembly-type physical dart target which can be quickly assembled or disassembled.

Another objective of the present invention is to provide the assembly-type physical dart target which has nice structural strength to form a target with a large area.

In order to achieve aforementioned objectives, the present invention provides an assembly-type physical dart target comprising a plurality of assembly plates, a plurality of engagement strips and a frame. Each of the plurality of assembly plates is formed by an arrow standing layer and a projection layer, and has surface gloss higher than that of the arrow standing layer. The arrow standing layer comprises sliding slots disposed on two sides thereof, respectively, and each of the sliding slots has a retraction side disposed on a side edge thereof away from the projection layer. Each of the plurality of engagement strips comprises two protruding side edges and an assembly part disposed thereon, each of the protruding side edges is engaged with the sliding slot, and the retraction side is configured for the assembly part to pass. The frame is configured to support the assembly plates and the plurality of engagement strips. Therefore, the target of the present invention can provide good projection effect and make the image projection technology work well in physical throwing exercise, and has nice structural strength to form a target with a large area; furthermore, the target of the present invention can be quickly assembled or disassembled, and a damaged part of the target can be replaced partially.

In an embodiment, the two protruding side edges are perpendicular to the assembly part, and each of the plurality of engagement strips is T-shaped. Therefore, the assembly part can be exposed to be assembled with the frame.

In an embodiment, the assembly part is protruded on the arrow standing layer. Therefore, a distance between the target and the frame can be adjusted.

In an embodiment, the material of the arrow standing layer is foamed material or shaped pulp molding material. Therefore, the arrow standing layer can have appropriate density to fasten the thrower without damaging the thrower.

In an embodiment, the material of the projection layer can be ethylene vinyl acetate. Ethylene vinyl acetate has nice softness, and elasticity and flexibility similar to rubber, and good surface gloss, so that projection effect of the target can be improved, and the hole broken by the thrower can be shrunken.

In an embodiment, the frame is a square frame body formed by two horizontal frames and two vertical frames. Therefore, the frame can have good rigidity.

In an embodiment, assembly-type physical dart target further comprises a plurality of support bases disposed on the two horizontal frame, and configured to enclose and support tops and bottoms of the plurality of engagement strips, respectively. Therefore, the engagement strip can be fastened well.

In an embodiment, material of each of the plurality of engagement strips is foamed material or shaped pulp molding material. Therefore, the engagement strip can have appropriate density to fasten the thrower without damaging the thrower.

In an embodiment, the frame has a bottom plate disposed behind the assembly plate.

In an embodiment, the assembly-type physical dart target further comprises an optical matrix sensor and a computation controller. The optical matrix sensor is disposed on the frame and in the front of the assembly plate, and the optical matrix sensor transmits shooting information to the computation controller for calculation.

BRIEF DESCRIPTION OF THE DRAWINGS

The structure, operating principle and effects of the present invention will be described in detail by way of various embodiments which are illustrated in the accompanying drawings.

FIG. 1 is a perspective view of an assembly process of a first embodiment of an assembly-type physical dart target of the present invention.

FIG. 2 is an exploded view of a part of the first embodiment of the present invention.

FIG. 3 is a perspective view of complete assembly of the first embodiment of the present invention, when viewed from a rear view angle.

FIG. 4 is a perspective view of complete assembly of the first embodiment of the present invention, when viewed from a front view angle.

FIG. 5 is a sectional view of complete assembly of the first embodiment of the present invention.

FIG. 6 is an enlarged view of a part of FIG. 5.

FIG. 7 is a schematic view of a thrower shot into a target of the first embodiment of the present invention.

FIG. 8 is an exploded view of a part of a second embodiment of the present invention.

FIG. 9 is a perspective assembly view of the second embodiment of the present invention.

FIG. 10 is a schematic sectional view of complete assembly of the second embodiment of the present invention.

FIG. 11 is a perspective view of an assembly process of a third embodiment of the present invention.

FIG. 12 is a sectional view of complete assembly of the third embodiment of the present invention.

FIG. 13 is a schematic view of a thrower shot into a target of the third embodiment of the present invention.

DETAILED DESCRIPTION OF THE PREFERRED EMBODIMENTS

The following embodiments of the present invention are herein described in detail with reference to the accompanying drawings. These drawings show specific examples of the embodiments of the present invention. These embodiments are provided so that this disclosure will be thorough and complete, and will fully convey the scope of the invention to those skilled in the art. It is to be acknowledged that these embodiments are exemplary implementations and are not to be construed as limiting the scope of the present invention in any way. Further modifications to the disclosed embodiments, as well as other embodiments, are also included within the scope of the appended claims. These embodiments are provided so that this disclosure is thorough and complete, and fully conveys the inventive concept to those skilled in the art. Regarding the drawings, the relative proportions and ratios of elements in the drawings may be exaggerated or diminished in size for the sake of clarity and convenience. Such arbitrary proportions are only illustrative and not limiting in any way. The same reference numbers are used in the drawings and description to refer to the same or like parts.

It is to be acknowledged that, although the terms 'first', 'second', 'third', and so on, may be used herein to describe various elements, these elements should not be limited by these terms. These terms are used only for the purpose of distinguishing one component from another component. Thus, a first element discussed herein could be termed a second element without altering the description of the present disclosure. As used herein, the term "or" includes any and all combinations of one or more of the associated listed items.

It will be acknowledged that when an element or layer is referred to as being "on," "connected to" or "coupled to" another element or layer, it can be directly on, connected or coupled to the other element or layer, or intervening elements or layers may be present. In contrast, when an element is referred to as being "directly on," "directly connected to" or "directly coupled to" another element or layer, there are no intervening elements or layers present.

In addition, unless explicitly described to the contrary, the word "comprise", "include" and "have", and variations such as "comprises", "comprising", "includes", "including", "has" and "having" will be acknowledged to imply the inclusion of stated elements but not the exclusion of any other elements.

Please refer to FIGS. 1 to 6. FIG. 1 is a perspective view of an assembly process of a first embodiment of the present invention, FIG. 2 is an exploded view of a part of the first embodiment of the present invention, FIG. 3 is a perspective view of complete assembly of the first embodiment of the present invention, when viewed from a rear view angle, and FIG. 4 is a perspective view of complete assembly of the first embodiment of the present invention, when viewed from a front view angle, FIG. 5 is a sectional view of complete assembly of the first embodiment of the present invention, and FIG. 6 is an enlarged view of a part of FIG. 5. The first embodiment of the assembly-type physical dart target of the present invention includes a plurality of assembly plates 10, a plurality of engagement strips 20, and a frame 30.

The plurality of assembly plates 10 can be assembled to form a target body having a larger area, for a thrower, such as arrow, dart or flying knife to attach or fasten. The plurality of engagement strips 20 are mainly configured to support the assembly plates 10, and fastened on the frame 30.

In this embodiment, each of the plurality of assembly plates 10 is formed by an arrow standing layer 11 and a projection layer 12, and has surface gloss higher than that of the arrow standing layer 11. The arrow standing layer 11 has sliding slots 13 disposed on two sides thereof, respectively, and each sliding slot 13 has a retraction side 131 disposed on a side edge thereof away from the projection layer 12.

In this embodiment, each of the engagement strips 20 comprises two protruding side edges 21 and an assembly part 22 disposed thereon. Each protruding side edge 21 is configured to engage with the sliding slot 13, and the retraction side 131 is configured for the assembly part 22 to pass.

The retraction side 131 between two assembly plates 10 can just allow the assembly part 22 to pass.

In this embodiment, the frame 30 is configured to support the plurality of assembly plates 10 and the plurality of engagement strips 20.

The assembly-type physical dart target of the present invention provides a target which is able to provide a good projection effect, make image projection technology work well in physical throwing exercise, and has nice structural strength to form a target with a large area; furthermore, the assembly-type physical dart target of the present invention can be quickly assembled or disassembled for replacing a damaged part partially.

Preferably, the two protruding side edges 21 are perpendicular to the assembly part 22, and each engagement strip 20 is T-shaped. Therefore, the assembly part 22 can be exposed to be assembled with the frame 30. In this embodiment, the plurality of engagement strips 20 can be fastened on the frame 30 by multiple support bases 34.

In this embodiment, the frame 30 is a square frame body formed by two horizontal frames 31 and two vertical frames 32, so that the frame 30 can have good rigidity. The two horizontal frames 31 and the two vertical frames 32 can be made by standard aluminum extrusion material, so as to reduce cost and obtain better rigidity. It will be understood that, besides aluminum extrusion material, the frame 30 can be made by other material, such as wood material, wood plate, or plastic material plate. The frame 30 may be supported in an upright position by base stands 33 associated with each of the vertical frames 32.

The frame 30 can include a plurality of support bases 34 disposed on the two horizontal frames 31 and configured to enclose and support a top and a bottom of the engagement strip 20, so as to fasten the engagement strips 20 stably.

Preferably, in order to enable the assembly-type physical dart target of the present invention to provide good projection effect and make image projection technology work well in physical throwing exercise, the material of the projection layer 12 can be ethylene vinyl acetate, which is made by copolymerizing ethylene and vinyl acetate and can be abbreviates as EVA. The characteristics of ethylene vinyl acetate include nice softness, and elasticity and flexibility similar to rubber, and very good surface gloss, and no toxicity, so that the projection effect of the target of the present invention can be improved; furthermore, when the thrower is pulled out from the target, the hole broken by the thrower can be shrunken automatically because of elasticity characteristic of EVA, so as to maintain integrity of the surface of the target and reduce the times of replacing the assembly plate 10.

Preferably, the material of the arrow standing layer 11 can be foamed material or shaped pulp molding material, so that the arrow standing layer 11 can have appropriate density to fasten the thrower without damaging the thrower.

Please refer to FIG. 7, which is a schematic view of a thrower shot into the target of the first embodiment of the present invention. When the thrower 50 is shot into the assembly plate 10, the thrower 50 pierces the projection layer 12 and is blocked by the arrow standing layer 11 and fastened on the arrow standing layer 11; since the thrower 50 is not damaged by the arrow standing layer 11 made by foamed material or pulp, durability of the thrower 50 can be extended.

When the thrower 50 is pulled out from the assembly plate 10, the broken hole can be shrunken automatically because of nice elasticity of the projection layer 12 made by EVA (the process is not shown in figures), thereby maintaining integrity of the projection layer 12 and reducing the times of replacing the assembly plate 10.

Preferably, the material of each engagement strip 20 can be foamed material or shaped pulp molding material, so as to prevent the thrower 50 shot on the engagement strip 20 from being damaged. Therefore, the engagement strips 20 can have appropriate density to fasten the thrower without damaging the thrower 50.

Preferably, the density and rigidity of material of the engagement strip 20 are higher than that of the arrow standing layer 11.

Please refer to FIGS. 8 to 10. FIG. 8 is an exploded view of a part of a second embodiment of the present invention, FIG. 9 is a perspective assembly view of the second embodiment of the present invention, and FIG. 10 is a schematic sectional view of complete assembly of the second embodiment of the present invention. In this embodiment, structures of the assembly plates 10 and the engagement strips 20 are substantially the same as that of the previous embodiment, and the main difference between this embodiment and the previous embodiment is that a frame 40 of this embodiment is formed by a simpler format. As shown in FIGS. 8 to 10, the frame 40 is formed by a bezel 41 and a bottom plate 42, and material of the frame 40 can be wood material or plastic material. The assembled assembly plates 10 and the engagement strips 20 can be directly mounted into the bezel 41 of the frame 40, and then fastened by a screwing or engaging manner, so that the assembly plate 10 can be assembled, disassembled, or replaced more easily.

Preferably, the frame 40 comprises a bottom plate 42 disposed behind the assembly plate 10. When the thrower 50 is shot on the arrow standing layer 11, the thrower 50 can be blocked by the bottom plate 42, to prevent the thrower 50 from piercing through the target to hurt person or damage article.

In this embodiment, the engagement strip 20 can be fastened with the bottom plate 42 directly by screw or nail, the assembly plate 10 can be engaged between two engagement strips 20 in advance; or, after the engagement strips 20 are fastened with the frame 40, the protruding side edge 21 of the engagement strip 20 can be slid into the sliding slot 13 of the assembly plate 10.

Preferably, the assembly part 22 is protruded on the arrow standing layer 11. As shown in FIG. 10, the length of the assembly part 22 can change a distance between the frame 40 and the assembly plate 10, so that the thrower 50 has a longer stroke to hit the frame 40.

Please refer to FIGS. 11 to 13. FIG. 11 is a perspective view of an assembly process of a third embodiment of the present invention, FIG. 12 is a sectional view of complete assembly of the third embodiment of the present invention, and FIG. 13 is a schematic view of a thrower shot into a target of the third embodiment of the present invention. In this embodiment, the target comprises an optical matrix sensor 60 and a computation controller 70, the optical matrix sensor 60 is disposed on the frame 30 and located in the front of the assembly plate 10. The front direction of the assembly plate 10 means a direction toward the shooter from the assembly plate 10.

In this embodiment, the optical matrix sensor 60 is mainly used to sense a position where the thrower 50 hits the target, and the optical matrix sensor 60 can be any optical sensing device; preferably, the optical matrix sensor 60 can be, but not limit the present invention, an infrared matrix sensor. As shown in figure, four bezels of the optical matrix sensor 60 can be disposed around the frame 30; preferably, the plurality of optical components 61 of the optical matrix sensor 60 can be densely disposed on inner sides of the upper and lower horizontal frames 31 and the left and right vertical frames 32, respectively, and the optical components 61 disposed on two sides and corresponding to each other can emit or receive light, as shown in figures, the optical component 61 disposed on a side emits light in the direction 62, and the optical component 61 disposed on the opposite side can receive the light. The infrared matrix sensor can use the optical components 61, which are densely disposed and arranged in a matrix in X and Y directions, to form grating, so as to detect and position any object entering the grating. When the thrower 50 hits the target, the thrower 50 blocks the infrared passing through the hitting position, so that the hitting position on the target can be determined. As shown in FIG. 13, when the thrower 50 hits the target, the light emitted by the optical component 61 at a coordinate in the direction 62 is blocked, the optical matrix sensor 60 can transmit a coordinate of the blocking signal to the computation controller 70 for calculation.

The computation controller 70 can include basic devices of a general computer, such as a processor, a memory and an input/output unit, the computation controller 70 receives location information from the optical matrix sensor 60, and performs calculation process on the location information, and then outputs a calculation result to a display device such as a scoring board or a display screen, for a shooter to view the shooting result; furthermore, the shooting result can be stored in a memory or uploaded to network.

Preferably, this embodiment can include a projector 71, which can be in cooperation with the computation controller 70 to process the projection image and the location information, so that infinite types of training, game or competition modes can be created by programming software of the target.

The present invention disclosed herein has been described by means of specific embodiments. However, numerous modifications, variations and enhancements can be made thereto by those skilled in the art without departing from the spirit and scope of the disclosure set forth in the claims.

What is claimed is:

1. An assembly-type physical dart target, comprising:

a plurality of assembly plates (10), wherein each of the plurality of assembly plates (10) is formed by an arrow standing layer (11) and a projection layer (12), and the projection layer has surface gloss higher than that of the arrow standing layer (11), the arrow standing layer (11) comprises sliding slots (13) disposed on two sides thereof, respectively, and each of the sliding slots (13) has a retraction side (131) disposed on a side edge thereof away from the projection layer (12);

a plurality of engagement strips (20), wherein each of the plurality of engagement strips (20) comprises two protruding side edges (21) and an assembly part (22) disposed thereon, each of the protruding side edges (21) is engaged with a sliding slot (13) of a corresponding assembly plate (10), and the retraction side (131) is configured for the assembly part (22) to pass; and a frame (30) configured to support the plurality of assembly plates (10) and the plurality of engagement strips (20), the frame (30) being formed by two horizontal frames (31) and two vertical frames (32), wherein a plurality of support bases (34) are fastened to the two horizontal frames (31) and configured to enclose and support tops and bottoms of the plurality of engagement strips (20), respectively; and an optical matrix sensor (60) and a computation controller (70), wherein the optical matrix sensor (60) is disposed on the frame (30) and in front of the plurality of assembly plates (10), and the optical matrix sensor (60) transmits shooting information to the computation controller (70) for calculation.

2. The assembly-type physical dart target according to claim 1, wherein the two protruding side edges (21) are perpendicular to the assembly part (22), and each of the plurality of engagement strips (20) is T-shaped.

3. The assembly-type physical dart target according to claim 1, wherein the assembly part (22) is protruded on the arrow standing layer (11).

4. The assembly-type physical dart target according to claim 1, wherein the material of the arrow standing layer (11) is foamed material or shaped pulp molding material.

5. The assembly-type physical dart target according to claim 1, wherein the material of the projection layer (12) is ethylene vinyl acetate.

6. The assembly-type physical dart target according to claim 1, wherein material of each of the plurality of engagement strips (20) is foamed material or shaped pulp molding material.

7. The assembly-type physical dart target according to claim 1, wherein the frame (40) has a bottom plate (42) disposed behind the plurality of assembly plates (10).

* * * * *